United States Patent [19]

Young

[11] Patent Number: 4,687,042

[45] Date of Patent: Aug. 18, 1987

[54] METHOD OF PRODUCING SHAPED METAL PARTS

[75] Inventor: Kenneth P. Young, Chesterfield, Mo.

[73] Assignee: Alumax, Inc., San Mateo, Calif.

[21] Appl. No.: 888,221

[22] Filed: Jul. 23, 1986

[51] Int. Cl.[4] ..... B22D 17/00; B22D 23/00

[52] U.S. Cl. ..... 164/80; 164/98; 164/113; 164/900

[58] Field of Search ..... 164/98, 80, 113, 900

[56] References Cited

U.S. PATENT DOCUMENTS

| | | | |
|---|---|---|---|
| 3,902,544 | 9/1975 | Flemings et al. | 164/900 X |
| 4,340,109 | 7/1982 | Roddy | 164/97 |
| 4,548,253 | 10/1985 | Funatani et al. | 164/97 X |
| 4,569,218 | 2/1986 | Baker et al. . | |

FOREIGN PATENT DOCUMENTS

| | | |
|---|---|---|
| 1129624 | 8/1982 | Canada . |
| 1136679 | 11/1982 | Canada . |
| 1499934 | 2/1978 | United Kingdom . |

OTHER PUBLICATIONS

M. C. Flemings, R. G., Riek, K. P. Young, "Rheocasting," *Materials Science and Engineering,* vol. 25 (1976), pp. 103–117.

G. B. Brook, "Improving the Quality of Aluminum Die Castings by Novel Techniques," *Material Design,* Oct., 1982, 3, (5), pp. 558–565.

S. D. E. Ramati, G. J. Abbaschian, D. G. Backman, R. Mehrabian, "Forging of Liquid and Partially Solid Sn–15% Pb and Aluminum Alloys," *Metallurgical Transactions,* vol. 9B, Jun., 1978, pp. 279–286.

*Primary Examiner*—Kuang Y. Lin

*Attorney, Agent, or Firm*—Malcolm B. Wittenberg

[57] ABSTRACT

An apparatus and process for producing shaped metal parts of a semi-solid metal slurry. The metal slurry is introduced as a preform slug or ingot to a prechamber which is subjected to sufficient pressure to force a portion of the semi-solid metal slurry from the prechamber to a metal part shaping die cavity. The completed metal part, together with the portion of metal which remained in the prechamber during part formation, is removed and the metal which remained in the prechamber is detached from the final metal part.

3 Claims, 3 Drawing Figures

METHOD OF PRODUCING SHAPED METAL PARTS

TECHNICAL FIELD OF THE INVENTION

The invention herein relates to a process and apparatus for producing shaped metal parts of exceedingly high quality from a preform ingot containing non-dendritic solid particles in a lower melting point liquid matrix.

BACKGROUND OF THE INVENTION

In providing materials for use in forging applications, it is known that materials formed from semi-solid thixotropic alloy slurries possess certain advantages, including improved part soundness. This results because the metal is partially solid as it enters the die cavity and, hence, less shrinkage occurs. Machine component life is also improved due to reduced erosion of dies and reduced thermal shock.

Methods for producing semi-solid thixotropic alloy slurries known in the prior art include mechanical stirring and inductive electromagnetic stirring. The process for producing such a slurry with the proper structure requires a balance between the shear rate imposed by the stirring and the solidification rate of the material being cast. The metal composition is characteristically either a solid or partially solid and partially liquid which comprises primary solid discrete particles in a secondary phase. The secondary phase is solid when the metal composition is solid and liquid when the metal composition is partially solid and partially liquid. The compositions are formed from a wide variety of metals or metal alloy compositions, while the primary particles comprise small degenerate dendrites or nodules which are generally spheroidal in shape and are formed as a result of agitating the metal alloy composition when the secondary phase is liquid. The primary solid particles are made up of a single phase or plurality of phases having an average composition different from the average composition of the surrounding matrix, which matrix can itself comprise primary and secondary phases upon further solidification.

Normally solidified alloys, in the absence of agitation, have branched dendrites separate from each other in the early stages of solidification, i.e., up to 15–20 weight percent solid, which develop into an interconnected network as the temperature is reduced and the weight fraction solids increase. Prior art, such as U.S. Pat. No. 3,954,455, teaches a method of preventing the formation of interconnected networks by maintaining the discrete primary particles separated from each other by the liquid matrix up to solids fractions of 60–65 weight percent or higher. The primary solids are degenerate dendrites in that they are characterized by having smoother surfaces, fewer branched structures, and a more spherical configuration as compared to normal dendritic structures.

There are several ways of forming alloy compositions useful in practicing the present invention which are all well known in the prior art. Typically, a metal alloy is first melted to a liquid state and introduced to a device which is capable of agitating the liquid during its solidification. The liquid-solid mixture can, when the desired ratio of liquid and solid has been reached, be cooled rapidly to form a solid slug for easy storage. Later, the slug can be raised to a temperature to form a liquid-solid mixture and then subjected to a casting or forging process to form the desired final part. The alloy thus possesses thixotropic properties when reheated to the liquid-solid state. In such a state it can be fed into a modified die casting or forging machine in apparently a solid form. However, shear resulting when this apparently solid slug is forced into the die cavity causes the slug to transform to a material whose properties are more nearly that of a liquid. An alloy slug having thixotropic properties can also be obtained by cooling the liquid-solid mixture to a temperature higher than that at which all of the liquid solidifies and the thixotropic composition can be cast or forged in that state.

The prior art has recognized that in preparing thixotropic alloy compositions, a surface skin tends to form on the preform ingot or slug as a result of an absence of agitation at the interface of the alloy composition and inner wall of the holding vessel. The prior art has attempted to reduce this problem by insulating the holding vessel during agitation and retard cooling of the alloy. Although the prior art has experienced various degrees of success in producing substantially uniform thixotropic compositions, it is virtually impossible to completely eliminate the dendritic "skin" from the finally-formed alloy ingot.

It is thus an object of the present invention to provide a process and apparatus for fabricating metal parts from thixotropic alloy compositions of the prior art which are substantially unaffected by the presence of the characteristic dendritic skin possessed by such thixotropic alloy ingots.

It is a further object of this invention to provide a process and apparatus for forming a forged metal part which is substantially stronger than corresponding forged metal parts of the prior art by producing the metal part from a thixotropic alloy composition substantially devoid of a surface containing dendritic skin and other skin-ladened impurities, which typically accompany thixotropic alloy slugs.

These and further objects of the present invention will be more readily visualized when considering the following disclosure and appended drawings, wherein FIGS. 1A through 1C illustrate, in cross-section, apparatus capable of carrying out the process of the present invention.

DETAILED DESCRIPTION OF THE INVENTION

Figure 1A:
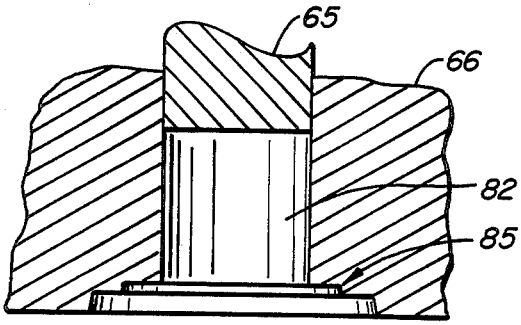
Figure 1A:
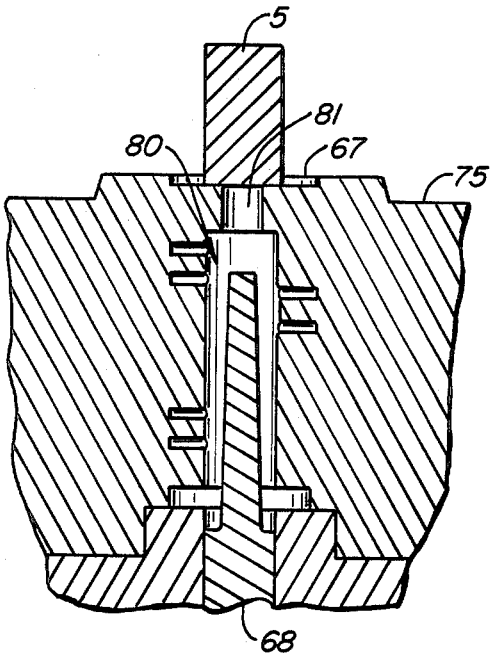

As previously noted, the prior art is replete with examples of attempts to produce semi-solid thixotropic alloy slurries exhibiting non-dendritic structure throughout substantially the entire cross-section of the finally-formed ingot or slug. For example, it is known in the prior art to postpone solidification until the slurry is within the agitation means, be it mechanical stirring blades or a rotating magnetic field. Prior art molds have been provided with insulating liners and/or insulating bands to postpone solidification, as taught in U.S. Pat. No. 4,450,893, issued on May 29, 1984.

It is also known in the prior art to control heat extraction from a molten material by providing a direct chill casting mold formed from a material having a relatively low thermal conductivity and having inserts formed from a material having a high thermal conductivity. Such a mold is illustrated in U.S. Pat. No. 3,612,158. Another approach is taken by U.S. Pat. No. 4,482,012, which teaches the use of a mold having a first chamber forming a heat exchanger portion, a physically separate second chamber forming a casting portion, and a refractory break transition region between the exit end of the heat exchanger portion and the inlet end of the casting portion. The cited patent teaches that the mold presented therein avoids formation of a peripheral dendritic structure by continuously converting the incoming molten material to a particulate slurry in the heat exchanger portion and then delivering the particulate slurry to the casting portion. However, it is virtually impossible to eliminate all of the peripheral dendritic structure or skin, the presence of which substantially undermines the structural integrity of the finally-formed metal part. Further, semi-solid thixotropic alloy compositions, like all metal bodies, tend to form an oxide on their surfaces which, if included in the final part, would again tend to undermine the integrity of the part.

The present invention is a process and apparatus used for carrying out the process for producing shaped metal parts from ingots or slugs composed of semi-solid thixotropic slurries having surface impurities thereon. The ingot is first introduced to a prechamber which is in fluid communication with a metal part shaping die cavity. The shaped metal part is then formed by causing a ram or other pressure means to be applied to the ingot located in the prechamber, causing a portion of the thixotropic metal composition to assume the shape of the metal part and a portion of the ingot to remain in the prechamber. The shearing resulting when the ingot is compressed by the oncoming ram which forces a portion thereof from the prechamber to the die cavity causes the thixotropic alloy to transform to a metal alloy whose properties are more nearly that of a liquid, thereby permitting the alloy to be shaped in conformance with the die cavity. Substantially all of the surface impurities remain in the prechamber and can be removed from the finally-shaped metal part upon its removal from the forging apparatus.

Turning first to FIG. 1A, a preform ingot or slug 5 is shown placed upon the lower ledge 75 of the forging apparatus within prechamber 67. The prechamber is typically an area in fluid communication with die cavity 80 by means of conduit 81, which is characterized as having a reduced cross-section as compared to prechamber 67, the purpose of which will be more readily apparent when further description is presented hereinafter.

It is contemplated that the present invention can be employed using preform ingots or slugs composed of virtually any alloy capable of being converted to a thixotropic mass. Metal compositions including alloys of aluminum, copper and iron among others can readily be employed. As a preferred embodiment, it is suggested that the preforms possess a solids fraction approximately 60% or greater to enhance the preform's ability to retain its structural integrity when placed on the die.

From the standpoint of physical dimension, the preform diameter must be greater than the diameter of conduit 81 to ensure that surface impurities stay with the biscuit and do not travel down the conduit to be made part of the finished product. A ratio of 2:1 between the biscuit diameter and conduit 81 diameter would be ideal.

The preform diameter further should preferably be no less than approximately 60% of the prechamber diameter, while the preform height should be greater than its diameter. As such the preform skin will remain in the prechamber and skin which resides on the bottom of the preform would not present a significant obstacle in practicing this invention.

Upon the placement of the semi-solid thixotropic preform ingot or slug 5 within prechamber 67, the upper element of the forging apparatus 66 is caused to lower upon the mating surface of element 75 and preform 5 caused to enter pressure chamber 82 below advancing ram 65. Although the ram can be composed of virtually any material well recognized as being useful in such applications, as a preferred embodiment a water-cooled copper alloy ram is contemplated. Such a ram would promote freezing of the biscuit in a region where surface defects associated with cold metal die surfaces is not important.

Figure 1B:
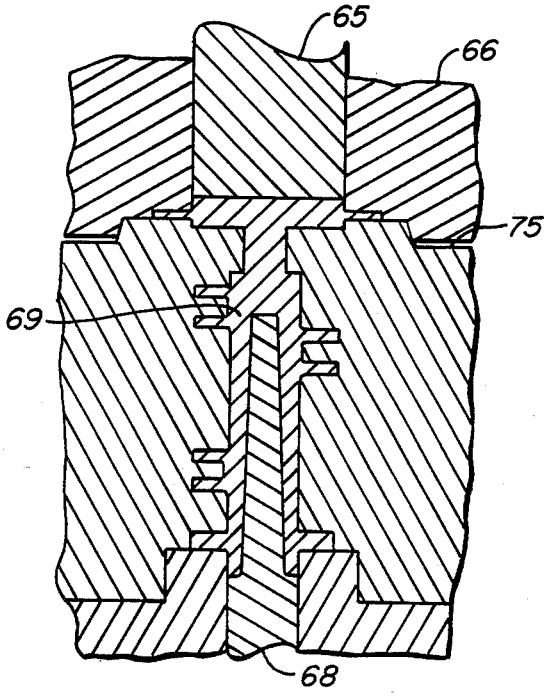
Figure 1C:
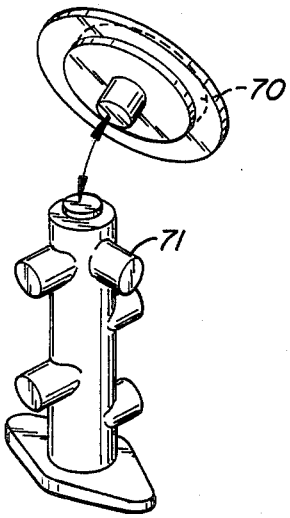

As ram 65 travels downwardly through pressure chamber 82, thixotropic alloy preform slug or ingot 5 is caused to deform as shown in FIG. 1B. It is noted that a portion of the preform 50 remains within prechamber 67, while the bulk of the thixotropic alloy is caused to proceed, under pressure, through conduit 81 and into die cavity 80 to form finally-shaped metal part 71 (FIG. 1C).

In progressing through the process depicted in FIGS. 1A and 1B, several notable events occur. First, it has been found that virtually all of the dendritic skin and other surface impurities, such as surface metal oxides, remain with the metal entrapped within prechamber 67. These impurities can be removed as shown in FIG. 1C by cutting and discarding impurity-containing section 70. Secondly, the metal which is forced into die cavity 80 through conduit 81 is caused to undergo shear principally because of the reduced cross-sectional area of conduit 81 as compared to the cross-sectional area of prechamber 67. The shearing of metal preform 5 causes the semi-solid thixotropic alloy to transform to a metal alloy whose properties are more nearly that of a liquid, thereby permitting it to be shaped into conformance to the die cavity.

A secondary but important additional benefit in practicing the present invention resides in the ability to forge parts having a much wider range of geometries than was previously believed possible. In conventional closed-die forging, as well as in press forging, as it has been practiced to date, the preform ingot or slug must be placed directly within the die cavity, and the ram employed to distort the preform, causing the semi-solid thixotropic alloy to fill the spaces within the die cavity forming the desired finished part. As a result, parts were limited in size by the amount of metal alloy which could be placed within the die cavity prior to forging. However, through the practice of the present invention, a prechamber of desired size could be fabricated to accommodate the appropriate preform ingot or slug and a sufficient amount of alloy caused to enter the die cavity region to fabricate parts of almost unlimited dimension.

As a further preferred embodiment, it is contemplated that the diameter of conduit 81 be larger than the part thickness to provide for proper metal feeding therethrough. The biscuit thickness should also be greater than the part thickness to ensure that the biscuit stays semi-solid until the part has frozen. Naturally, the ram should be retained in place to keep the biscuit under pressure in order to enhance complete solidification of the parts.

As yet another preferred embodiment, an entrapment ring 85 is configured as part of the upper element of the forging apparatus 66. The purpose of entrapping ring 85 is to trap debris or metal skimmed from the preform as the forging apparatus closes. Such debris would of course become part of biscuit 70 and would be discarded as shown in FIG. 1C.

The invention will be further described in the following illustrative examples wherein all parts are by weight unless otherwise expressed.

EXAMPLE

Aluminum alloy ingots containing 7.15% Si, 0.116% Fe, 0.007% Mn, 0.063% Mg, 0.029% Zn, and 0.107% Ti, were melted in an electric induction furnace and magnesium added to raise the bulk magnesium content to 1.06%. The alloy was then cast, using conventional techniques, into a semi-solid thixotropic alloy in a cylindrical shape having a diameter of 2 in. and a length of 4.25 in., and placed on a rotary heating table such as that shown in U.S. Pat. No. 4,569,218.

Induction coil current was 785 amps at a frequency of 1,000 Hz. Rotary index time was set at 20 seconds through a total of 10 coils. Total heating time was therefore 200 seconds. Upon exiting from the tenth coil at approximately 75% solid, 25% liquid, the reheated preform slug was transferred to a die maintained at approximately 400° F. A 2.5 in. diameter prechamber was used to accept the preform slug within the die, whereupon a ram advancing at a speed of 15 in. per second was employed to force the interior metal of the slug through a 1 in. diameter orifice and into the die cavity, forming a master brake cylinder.

Upon completion of the full stroke, compression of approximately 14–20 Kg/in.$^2$ was maintained upon the master cylinder cavity for a total of six seconds, whereupon the ram was withdrawn and the cavity opened. The master cylinder was then removed and quenched in cold water at 65° F. within five seconds. After quenching, the master cylinder was aged for eight hours at 340° F. and subsequently air-cooled.

After aging, the hardness of the master cylinder was found to average 94 $R_e$ and 115 Brinell. Mechanical test bars cut from the main portion of the master cylinder exhibited a tensile strength of 45,000 psi and a yield of 42,000 psi and elongation of 7%.

It is quite obvious from a review of the above-recited disclosure when read in conjunction with the appended figures that in its most preferred embodiment, the preform slug is placed within a preform cavity having sidewalls which communicate with communication means of diminished cross-sectional area. The preform slug, preferably in the shape of a cylinder, is caused to press against the sidewalls of the prechamber through the action of the ram, causing a skimming effect to take place upon the metal shell of the preform slug, allowing substantially only the interior metal to enter the die cavity. The impurities are thus retained in the prechamber, resulting in a metal part of extremely high purity.

What is claimed is:

1. A process for producing shaped metal parts comprising (a) introducing a metal preform to a prechamber of a shaping means used to shape a metal part from the preform, said preform metal being characterized as comprising a semi-solid slurry of primary solid phase particles ina lower melting point molten metal, said metal preform being further characterized as possessing a dendritic metal shell about its periphery which substantially entirely resides within the prechamber upon formation of the metal part;

(b) forming the shaped metal part in a die cavity by applying pressure to the metal preform located in the prechamber causing a portion of the metal preform to assume the shape of the shaped metal part and a portion of the preform, including the substantially entire dendritic metal shell, to remain in the prechamber; and (c) withdrawing the shaped metal part from the shaping means and, thereupon, removing the metal which remained in the prechamber during the forming of the metal part from the metal part itself.

2. The process of claim 1 wherein the portion of the metal preform which is communicated from the prechamber to form the shaped metal part is caused to undergo shear prior to reaching the die cavity.

3. The process of claim 1 wherein said metal preform comprises a metal selected from the group consisting of aluminum alloys, copper alloys, and ferrous alloys.

* * * * *